US011207911B2

(12) United States Patent
Williams

(10) Patent No.: US 11,207,911 B2
(45) Date of Patent: Dec. 28, 2021

(54) FOLDER SAVERS

(71) Applicant: Margaret Williams, Del Mar, CA (US)

(72) Inventor: Margaret Williams, Del Mar, CA (US)

(73) Assignee: Margaret Williams, Del Mar, CA (US)

( * ) Notice: Subject to any disclaimer, the term of this patent is extended or adjusted under 35 U.S.C. 154(b) by 0 days.

(21) Appl. No.: 16/039,019

(22) Filed: Jul. 18, 2018

(65) Prior Publication Data

US 2018/0319198 A1 Nov. 8, 2018

Related U.S. Application Data

(63) Continuation-in-part of application No. 14/697,611, filed on Apr. 27, 2015, now abandoned.

(60) Provisional application No. 61/984,753, filed on Apr. 26, 2014.

(51) Int. Cl.

| | |
|---|---|
| ***B42F 3/00*** | (2006.01) |
| ***B31F 5/08*** | (2006.01) |
| ***B42F 11/00*** | (2006.01) |

(52) U.S. Cl.

CPC ..... *B42F 3/006* (2013.01); *B31F 5/08* (2013.01); *B42F 11/00* (2013.01); *B42P 2241/08* (2013.01); *B42P 2241/20* (2013.01)

(58) Field of Classification Search

CPC .. B42F 3/006; B42F 11/00; B31F 5/08; B42P 2241/08; B42P 2241/20

See application file for complete search history.

(56) References Cited

U.S. PATENT DOCUMENTS

| | | | | |
|---|---|---|---|---|
| 3,670,434 | A * | 6/1972 | Shibata | B42F 5/00 40/772 |
| 4,583,764 | A | 4/1986 | Steffen | |
| 5,590,972 | A | 1/1997 | Shobin | |
| 5,683,194 | A | 11/1997 | Emmel et al. | |
| 6,409,409 | B2 * | 6/2002 | Bauman | B42F 7/02 229/67.1 |
| 2002/0093186 | A1 * | 7/2002 | Bullock | B42F 7/02 281/29 |
| 2013/0306715 | A1 * | 11/2013 | James, Jr. | B65D 27/08 229/72 |
| 2016/0221381 | A1 * | 8/2016 | Cushing | B42D 15/0093 |

FOREIGN PATENT DOCUMENTS

| | | | |
|---|---|---|---|
| GB | 2099361 | A | 12/1982 |
| WO | WO-9943489 | A1 | 9/1999 |

* cited by examiner

*Primary Examiner* — Cynthia L Schaller

(74) *Attorney, Agent, or Firm* — Mintz, Levin Cohn, Ferris, Glovsky and Popeo, P.C.

(57) ABSTRACT

The present technology relates generally to devices and methods for preserving the integrity of folders that are placed into ringed binders or notebooks, preferably folders that are made of paper or other like material, and which are used for example for the transport and storage of papers by students or other types of users.

20 Claims, 2 Drawing Sheets figure 1
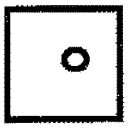
figure 3
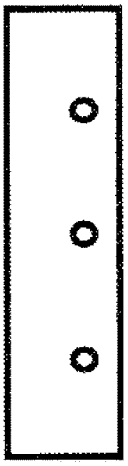
figure 2
figure 4
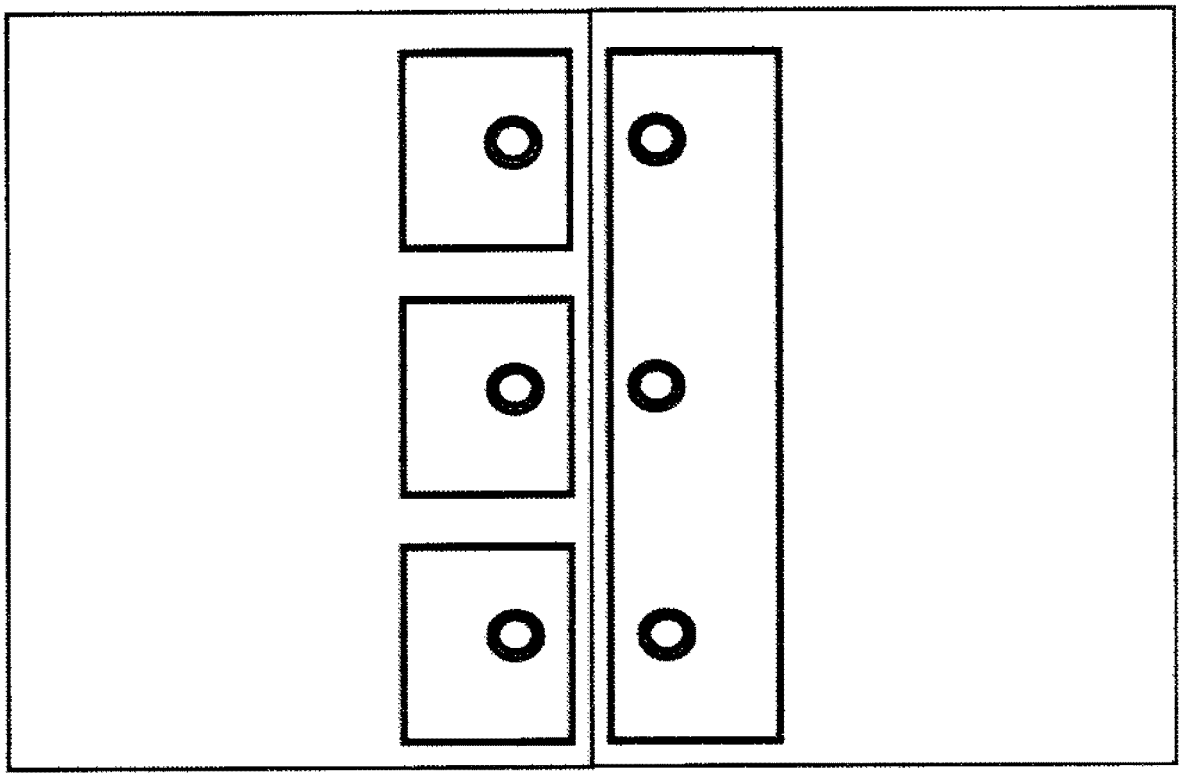

FOLDER SAVERS

CROSS-REFERENCE TO RELATED APPLICATIONS

This application is a continuation-in-part of U.S. application Ser. No. 14/697,611, entitled "FOLDER SAVERS," filed on Apr. 27, 2015, which claims priority to U.S. Provisional Application No. 61/984,753, filed on Apr. 26, 2014, the entireties of each of which are incorporated by reference herein.

The present technology relates generally to the field of devices and methods for preserving the integrity of folders that are placed into ringed binders or notebooks, preferably folders that are made of paper or other like material, and which are used for example for the transport and storage of papers by students or other types of users.

BACKGROUND

Folders are widely used by students to carry, transport and preserve their school papers. For example, school students may have one or more folders for each of their various classes or subjects in schools. The folders may be subjected to significant physical activity over the course of their use, for example when they are used, when they are placed into or taken out of school bags, when they are placed into and/or removed from larger binders that have rings that the folders are attached to, when they transported, and so on.

The present technology relates to devices and methods for preserving or extending the integrity and useful life of such folders and notebooks.

BRIEF DESCRIPTION OF THE DRAWINGS

The accompanying drawing(s), which are incorporated in and constitute a part of this specification, illustrate several aspects described below.

FIG. 1 is a non-limiting depiction of one embodiment of a reinforcement device for use with a single hole on a folder.

FIG. 2 is a non-limiting depiction showing three reinforcement devices according to FIG. 1 affixed to a folder that has three holes for use with a three-ring binder.

FIG. 3 is a non-limiting depiction of one embodiment of a reinforcement device that has three holes, which can be used with a three-ring binder.

FIG. 4 is a non-limiting depiction showing a reinforcement device from FIG. 3 affixed to a folder that has three holes so that it can be used with a three-ring binder.

DETAILED DESCRIPTION OF THE PREFERRED EMBODIMENTS

Figure 5:
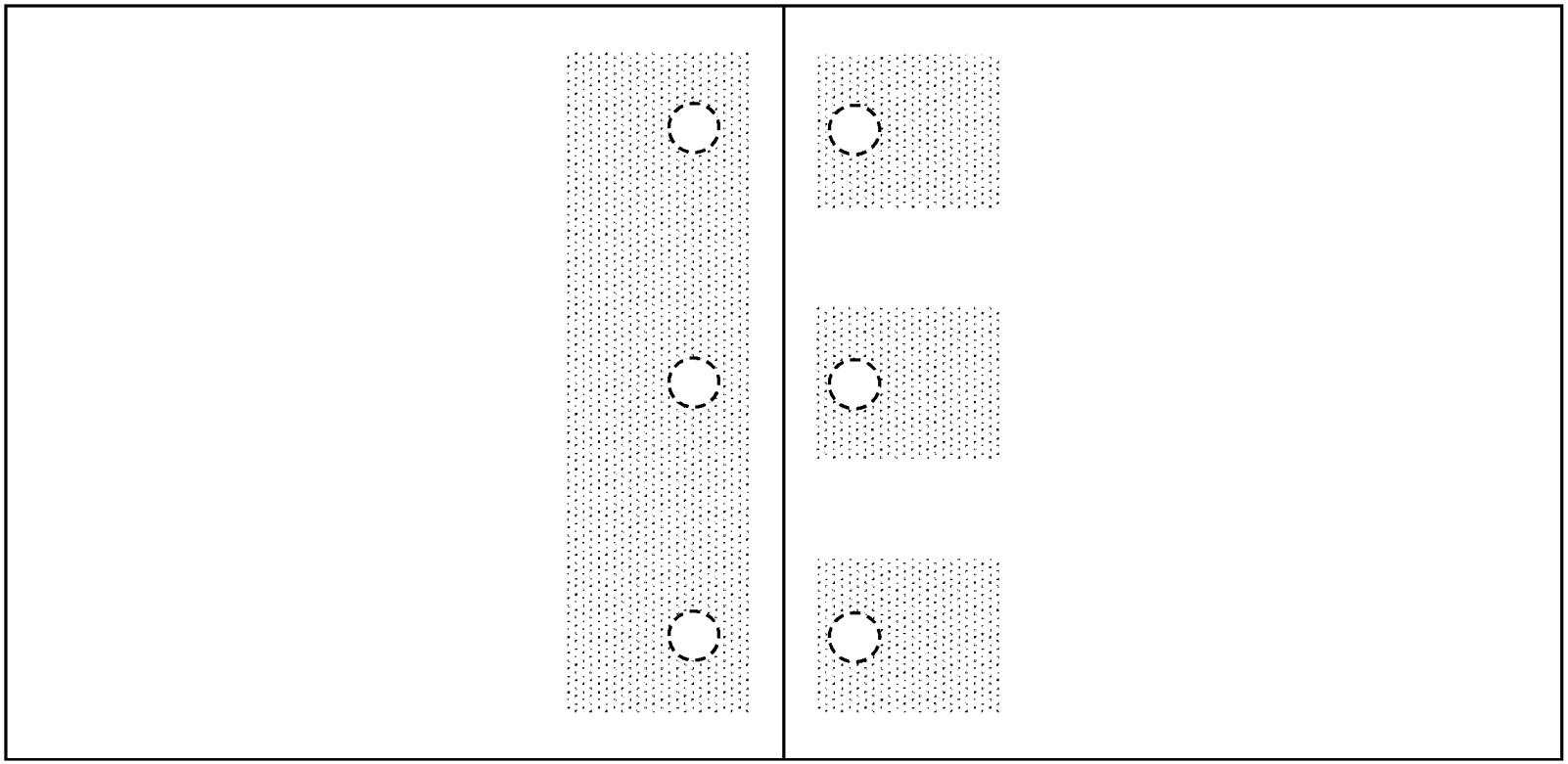
FIG. 5 is a non-limiting example showing a reinforcement device from FIGS. 1 and 2 integrally formed with a folder that has three holes so that it can be used with a three-ring binder.

Embodiments herein generally relate to devices and methods for maintaining, preserving and/or enhancing the integrity, strength and lifespan of folders that are placed, for example, into ringed binders by students. One challenge is that such folders fail to last for a sufficient period of time, for example, the duration of a school term (e.g., the quarter, semester or school year). Embodiments described herein can alleviate such challenges, thereby preventing the loss or destruction of important papers and saving valuable money and resources due to not having to replace the folders as frequently due their extended lifespan. Described herein are devices and methods related to "saving" such folders and articles.

It is to be understood that this invention is not limited to particular embodiments described, as such may, of course, vary. It is also to be understood that the terminology used herein is for the purpose of describing particular embodiments only, and is not intended to be limiting, since the scope of this invention will be limited only by the appended claims.

The detailed description of the invention is divided into various sections only for the reader's convenience and disclosure found in any section may be combined with that in another section. Unless defined otherwise, all technical and scientific terms used herein have the same meaning as commonly understood by one of ordinary skill in the art to which this invention belongs.

It must be noted that as used herein and in the appended claims, the singular forms "a", "an", and "the" include plural referents unless the context clearly dictates otherwise. Thus, for example, reference to "a compound" includes a plurality of compounds.

Unless defined otherwise, all technical and scientific terms used herein have the same meaning as commonly understood by one of ordinary skill in the art to which this invention belongs. As used herein the following terms have the following meanings.

The term "about" when used before a numerical designation, e.g., length, size, etc., including ranges, indicates approximations which may vary by (+) or (−) 10%, 5% or 1%, or any subrange or subvalue there between.

"Comprising" or "comprises" is intended to mean that the compositions and methods include the recited elements, but not excluding others. "Consisting essentially of when used to define compositions and methods, shall mean excluding other elements of any essential significance to the combination for the stated purpose. Thus, a reinforcement device or method consisting essentially of the elements as defined herein would not exclude other materials or steps that do not materially affect the basic and novel characteristic(s) of the claimed invention. "Consisting of shall mean excluding more than trace elements of other ingredients and substantial method steps. Embodiments defined by each of these transition terms are within the scope of this invention.

Examples of Reinforcement Devices

Some embodiments herein generally relate to reinforcement devices that can help maintain and/or reinforce folders, for example, hole-punched folders. Some embodiments relate to reinforcement devices that can be affixed to the folders. For example, the reinforcement devices can be affixed using glue, tape, clips or some other mechanism or means for attachment. In some cases, the reinforcements can include an adhesive already in place such that the device can be used without need of adding any adhesive. In some embodiments, the reinforcement device is integrally formed with the folder.

The reinforcement devices can be of any suitable material, however in some embodiments they can be made of paper or other like material, including "cardstock" paper that provides added strength. In some embodiments, the reinforcement devices can be made of a material such as a plastic or other polymer material. Such devices can provide added strength and integrity in some cases, and may provide an ultra-strong reinforcement. Preferably, in some embodiments, the device can be made of a tear resistant material or a material that may be tear resistant, but when added to the folder material provides added strength.

The reinforcement devices may also include a coating layer. The coating layer and the reinforcement device may be made of the same material or may include different materials. The coating layer may be integrally formed as part of the reinforcement device, and/or may be formed separately such that the coating layer may be later applied to at least a portion of a surface of the reinforcement device, such as via an adhesive that is part of the devices, part of the coating layer, and/or a separate adhesive. The coating layer, separate from, or in addition to the reinforcement device, may be integrally formed with the folders and/or later applied to the folders around and/or adjacent to one or more holes of the folder. For example, FIG. 5 shows a non-limiting example folder integrally formed with a reinforcement device having a coating layer. Of course, as described herein, the coating layer may be integrally formed with the reinforcement device and/or the folder, or applied separately to the reinforcement device and/or the folder.

The coating layer may include one or more materials, such as rubber or a rubberized material, plastic, sand paper, hook and loop fabric, magnetic material texturized paper, cardboard, acrylic, nylon, foam board, vinyl, felt, silicon rubber, acrylic (e.g., acrylic plastic), polyvinyl chloride, acrylonitrile butadiene styrene, a texture spray, and/or other materials. The material of the coating layer may be the same or different from the material of the reinforcement device and/or the folder. The material of the coating layer and/or the reinforcement device may have a high coefficient of friction or may include a friction material or surface. Non-limiting examples of ranges of the coefficient of friction of the material may include 0.5 to 0.8, 0.6 to 0.7, 0.5 to 0.8, 0.2 to 0.4, 0.3 to 0.5, 0.1 to 0.3 or ranges above, below, or therebetween. The coating layer may alternatively or additionally include a textured surface (e.g., having one or more of a ribbed, threaded, cross-linked, criss-cross pattern or texture, checkered pattern, lined (e.g., straight or wavy ribs), polkadot pattern, etc.) and/or a friction surface. In some embodiments the texture can include raised lines, dots, grains, etc., in a regular (e.g., a consistent pattern, spacing, geometric shape, etc.) or irregular pattern. The coating layer may include a roughened surface. The coating layer may include one or more colors, or images. The colors or images may overlay one or more of the textures and/or patterns. The images may include characters, scenery, pictures, patterns, or other visual imagery. The surface of the coating layer and/or the material of the coating layer may desirably allow other objects, such as paper, plastic, or other objects, to be stored within the folders, yet reduce the likelihood that the materials (e.g., the paper) will slide relative to the folder, such as out of the folder. The coating layer may limit or prevent the object from sliding relative to the folder due, at least in part, to the increased friction between the coating layer and the object. The coating layer, such as the surface of the coating layer, may increase the coefficient of friction between the reinforcement device and the object stored within the folder, such as when the object stored within the folder contacts the coating layer of the reinforcement devices. The increase in coefficient of friction may help to secure the object (e.g., the paper) within the folder. In some configurations, the reinforcement device can help to limit or prevent the object from slipping relative to the folder or sliding out of the folder, regardless of the type of material of the folder.

The coating layer may alternatively or additionally desirably provide structural rigidity to the folder, etc., such as around one or more holes of the folder. The coating layer material may increase the thickness of a portion of the region surrounding the holes in the folder to reduce the likelihood that the folder will tear or otherwise be compromised in that region, while maintaining a relatively low overall weight of the folders.

Additionally, various sizes can be utilized. FIG. 1 depicts one example of a "small" device, while FIG. 2 depicts another non-limiting example of a larger device. The depicted devices can be made of any suitable material, for example, as described herein. The depicted devices included one or more holes that can correspond with one or more holes on a folder. The folder can come with pre-punched holes or the user can use the devices to reinforce holes that the user puts into a folder that does not come with holes.

The devices are designed to reinforce the folder around one or more of the holes of device, for example, to prevent, tearing or ripping of the folder material around each hole, such that it can remain in a ringed binder.

The reinforcement devices can come with an adhesive side so they can be immediately affixed to the folder. For example, the devices can include a removable backing that guards the sticky or adhesive material against soiling or premature sticking. The backing can then be removed just prior to use.

FIG. 1 depicts a non-limiting example of a small device that is configured for use on one hole of a folder. The depicted device can be of any suitable size, but as depicted is intended to be two by two square. The hole is positioned with the center about 25 mmm or approximately 1 inch from the top edge. The distance from the center of the hole to the right edge of paper is approximately 10 mm such that it is not centered in the middle of the square on all sides. The diameter of the hole can be any suitable size, for example approximately or about 8 mm or 5/16 of an inch. In some embodiments, the device can have a width of approximately 1 to 1.25 inches, or more inches. The width of the device may provide structural rigidity and/or support to the folder when applied to the folder. FIG. 2 shows the device in place on a folder, which actually shows three devices used together on a three-ring folder that can be placed into a three-ringed binder.

FIG. 3 depicts a non-limiting example of a large device that is configured for use with multiple holes on a folder. The depicted device can be of any desired size, for example, 2 inches by 11 inches. As depicted, the holes are positioned symmetrically with the centers of the holes about 108 mm or 4¼ inches apart. The holes can positioned at any desired location with respect the edge of the device. The hole is posited with the center about 25 mmm or approximately 1 inch from the top edge. The distance from the center of the hole to the right edge of paper is approximately 10 mm such that it is not centered in the middle of the square on all sides. The diameter of the hole can be any suitable size, for example approximately or about 8 mm or 5/16 of an inch.

FIG. 4 shows the device of FIG. 3 in place on a folder having three holes. It should be understood that the devices can be configured with binders have various ring configurations. For example, the devices can be configured and sized for use with two-, three-, four- and six-ring binders, or binders with any other number of rings. Similarly, the location of the holes can be adjusted so as to align properly with the edge of the folder, for example, so as to not extend beyond any edge of the folder.

As mentioned above, FIG. 5 shows an example folder integrally formed with a reinforcement device (such as the reinforcement devices shown in FIGS. 1 and 2) having a coating layer.

It should be understood that the devices can be made by any suitable method. With the benefit of this description the skilled artisan can use any suitable methodology for making the devices.

Methods of Using the Invention

The reinforcement devices can be used in any suitable manner. For example, a typical folder will have at least 4 potential sides upon which the devices can be affixed, two on the outside of the folder and two on the inside of the folder. A user can affix the devices on one or more holes of folder and on one or more sides of the folder. For example, if a user desired to use a device according to FIG. 1 on all holes on all sides of a folder for use with a three-ring binder, then 12 of the devices would be required. Each device would be affixed to each hole on each of the four sides of the folder.

Similarly, reinforcement devices according to FIG. 3 could be affixed to 1, 2, 3, or 4 sides of a typical folder, as desired. In some aspects, a user could mix-and-match the devices of FIG. 1 along with the devices of FIG. 3.

In some embodiments, the reinforcement devices are preformed with the folders or other materials.

The contents of all reference(s), patent(s), and patent application publication(s) cited in this application are hereby incorporated by reference in their entireties.

What is claimed is:

1. A method of reinforcing and prolonging the usable life of a folder that is fastened to a ringed notebook binder, comprising, providing a folder having six holes through which three rings of the ringed notebook binder pass in order to fasten the folder to the binder, the folder comprising a first panel and a second panel, the first panel and the second panel each comprising three of the six holes;

providing a first reinforcement device to the first panel, the first reinforcement device comprising:

a first planar sheet including:

a first side and an opposing second side;

three pre-formed holes defined by the first planar sheet; and a glue or other sticky substance on one of the first side and the opposing second side to facilitate affixing the first reinforcement device to the first panel of the folder such that each of the three holes of the first panel of the folder and each of the three pre-formed holes of the first reinforcement device sufficiently align to allow each of the three rings from the ringed notebook binder to pass through each of the three corresponding holes of the first panel of the folder and each of the three corresponding pre-formed holes of the first reinforcement device, wherein the first reinforcement device is made of one or more of paper, cardstock paper, a plastic, or a polymer, and wherein each of the three pre-formed holes is laterally offset from a centerline of the first planar sheet such that each of the three pre-formed holes is positioned closer towards an inner edge than an outer edge of the first planar sheet; and a first coating layer comprising a friction material and a textured surface, the friction material and the textured surface configured to limit movement of an object residing within the folder when the object contacts the first coating layer, first coating layer being positioned on an inside of the first panel of the folder and around each of the three pre-formed holes, thereby increasing the thickness of the first planar sheet around each of the three pre-formed holes and reducing the likelihood that the folder will tear;

attaching the first reinforcement device to the first panel of the folder so that the first reinforcement device is affixed to the first panel of the folder in a position that each of the three pre-formed holes of the first reinforcement device is aligned with each of the three holes of the first panel of the folder to permit each of the three rings of the three rings from the ringed notebook binder to pass through both the three holes of the first panel of the folder and the three pre-formed holes of the first reinforcement device, wherein the first reinforcement device provides added resistance to the first panel against the three rings of the ringed notebook binder from tearing through each of the three holes of the first panel of the folder, compared to when the first reinforcement device is not present; and providing a second reinforcement device to the second panel, the second reinforcement device comprising:

a second planar sheet including:

a first side and an opposing second side;

one pre-formed hole defined by the second planar sheet; and a glue or other sticky substance on one of the first side and the opposing second side of the second planar sheet to facilitate affixing the second reinforcement device to the second panel of the folder such that a first hole of the three holes of the second panel of folder and the one pre-formed hole of the second reinforcement device sufficiently align to allow a first ring of the three rings from the ringed notebook binder to pass through the first hole of the three holes of the second panel of the folder and the one pre-formed hole of the second reinforcement device, wherein the second reinforcement device is made of one or more of paper, cardstock paper, a plastic, or a polymer, and wherein the one pre-formed hole of the second reinforcement device is laterally offset from a centerline of the second planar sheet such that the one pre-formed hole of the second reinforcement device is positioned closer towards an inner edge than an outer edge of the second planar sheet; and a second coating layer comprising a friction material and a textured surface, the friction material and the textured surface of the second coating layer configured to limit movement of the object residing within the folder when the object contacts the second coating layer, the second coating layer being positioned on the inside of the second panel of the folder and around the one pre-formed hole of the second reinforcement device, thereby increasing the thickness of the second planar sheet around only the one pre-formed hole of the second reinforcement device and reducing the likelihood that the folder will tear; and attaching the second reinforcement device to the second panel of the folder so that the second reinforcement device is affixed to the second panel of the folder in a position that the one pre-formed hole of the second reinforcement device is aligned with the first hole of the three holes of the second panel of the folder to permit the first ring of the three rings from the ringed notebook binder to pass through both the first hole of the three holes of the second panel of the folder and the one pre-formed hole of the second reinforcement device, wherein the second reinforcement device provides added resistance to the second panel against the first ring of the three rings of the ringed notebook binder from tearing through the first hole of the three holes of the second panel of the folder, compared to when the second reinforcement device is not present.

2. The method of claim 1, wherein the friction material of the first coating layer and the friction material of the second coating layer each includes a rubberized material.

3. The method of claim 1, wherein the friction material of the first coating layer is pre-formed with the first reinforcement device and the friction material of the second coating layer is pre-formed with the second reinforcement device.

4. The method of claim 1, wherein the friction material of the first coating layer and the friction material of the second coating layer each includes a plastic material.

5. The method of claim 1, wherein the textured surface of the first coating layer and the textured surface of the second coating layer each includes one or more of a ribbed and a threaded pattern.

6. The method of claim 1, further comprising:

providing a third reinforcement device to the second panel, the third reinforcement device comprising:

a third planar sheet including:

a first side and an opposing second side;

one pre-formed hole defined by the third planar sheet; and a glue or other sticky substance on one of the first side and the opposing second side of the third planar sheet to facilitate affixing the third reinforcement device to the second panel of the folder such that a second hole of the three holes of the second panel of folder and the one pre-formed hole of the third reinforcement device sufficiently align to allow a second ring of the three rings from the ringed notebook binder to pass through the second hole of the three holes of the second panel of the folder and the one pre-formed hole of the third reinforcement device, wherein the third reinforcement device is made of one or more of paper, cardstock paper, a plastic, or a polymer, and wherein the one pre-formed hole of the third reinforcement device is laterally offset from a centerline of the third planar sheet such that the one pre-formed hole of the third reinforcement device is positioned closer towards an inner edge than an outer edge of the third planar sheet; and a third coating layer comprising a friction material and a textured surface, the friction material and the textured surface of the third coating layer configured to limit movement of the object residing within the folder when the object contacts the third coating layer, the third coating layer being positioned on the inside of the second panel of the folder and around the one pre-formed hole of the third reinforcement device, thereby increasing the thickness of the third planar sheet around only the one pre-formed hole of the third reinforcement device and reducing the likelihood that the folder will tear; and attaching the third reinforcement device to the second panel of the folder, independent of the first reinforcement device and the second reinforcement device, so that the third reinforcement device is affixed to the second panel of the folder in a position that the one pre-formed hole of the third reinforcement device is aligned with the second hole of the three holes of the second panel of the folder to permit the second ring of the three rings from the ringed notebook binder to pass through both the second hole of the three holes of the second panel of the folder and the one pre-formed hole of the third reinforcement device, wherein the third reinforcement device provides added resistance to the second panel against the second ring of the three rings of the ringed notebook binder from tearing through the second hole of the three holes of the second panel of the folder, compared to when the third reinforcement device is not present.

7. A reinforcement system for reinforcing at least one hole of a folder, the reinforcement system comprising:

a first reinforcement device coupled to a first panel of a folder, the first reinforcement device comprising:

a first planar sheet including:

a first side and an opposing second side;

three pre-formed holes defined by the first planar sheet; and a glue or other sticky substance on one of the first side and the opposing second side of the first reinforcement device to facilitate affixing the first reinforcement device to the first panel of the folder such that each of the three holes of the folder and each of the three pre-formed holes of the first reinforcement device sufficiently align to allow each of three rings from a ringed binder to pass through each of the three corresponding holes of the first panel of the folder and each of the three corresponding pre-formed holes of the first reinforcement device, wherein the first reinforcement device is made of one or more of paper, cardstock paper, a plastic, or a polymer, and wherein each of the three pre-formed holes is laterally offset from a centerline of the first planar sheet such that each of the three pre-formed holes is positioned closer towards an inner edge than an outer edge of the first planar sheet; and a first coating layer comprising a friction material and a textured surface, the friction material and the textured surface configured to limit movement of an object residing within the folder when the object contacts the first coating layer, the first coating layer being positioned on an inside of the first panel of the folder and around each of the three pre-formed holes, thereby increasing the thickness of the first planar sheet around each of the three pre-formed holes and reducing the likelihood that the folder will tear; and a second reinforcement device coupled to a second panel of the folder, the second reinforcement device comprising:

a second planar sheet including:

a first side and an opposing second side;

one pre-formed hole defined by the second planar sheet; and a glue or other sticky substance on one of the first side and the opposing second side of the second planar sheet to facilitate affixing the second reinforcement device to the second panel of the folder such that a first hole of the three holes of the second panel of folder and the one pre-formed hole of the second reinforcement device sufficiently align to allow a first ring of the three rings from the ringed binder to pass through the first hole of the three holes of the second panel of the folder and the one pre-formed hole of the second reinforcement device, wherein the second reinforcement device is made of one or more of paper, cardstock paper, a plastic, or a polymer, and wherein the one pre-formed hole of the second reinforcement device is laterally offset from a centerline of the second planar sheet such that the one pre-formed hole of the second reinforcement device is positioned closer towards an inner edge than an outer edge of the second planar sheet; and a second coating layer comprising a friction material and a textured surface, the friction material and the textured surface of the second coating layer configured to limit movement of the object residing within the folder when the object contacts the second coating layer, the second coating layer being positioned on the inside of the second panel of the folder and around the one pre-formed hole of the second reinforcement device, thereby increasing the thickness of the second planar sheet around only the one pre-formed hole of the second reinforcement device and reducing the likelihood that the folder will tear.

8. The reinforcement system of claim 7, wherein the friction material of the first coating layer and the friction material of the second coating layer each includes a rubberized material.

9. The reinforcement system of claim 7, wherein the first coating layer is integrally formed with the first reinforcement device and the second coating layer is integrally formed with the second reinforcement device.

10. The reinforcement system of claim 7, wherein the first coating layer is separately formed from the first reinforcement device and applied separately to the first reinforcement device and the second coating layer is separately formed from the second reinforcement device and applied separately to the second reinforcement device.

11. The reinforcement system of claim 7, wherein the friction material of the first coating layer and the friction material of the second coating layer each includes a plastic material.

12. The reinforcement system of claim 7, wherein the textured surface of the first coating layer and the textured surface of the second coating layer each includes one or more of a ribbed and a threaded pattern.

13. The reinforcement system of claim 7, wherein the first planar sheet and the second planar sheet each has a length greater than 0.75 inches and a width greater than 0.75 inches.

14. The reinforcement system of claim 13, wherein the length and the width are the same.

15. The reinforcement system of claim 13, wherein the width is about 1 to 1.25 inches.

16. The reinforcement system of claim 13, wherein the width is about 2 inches.

17. The reinforcement system of claim 13, wherein the length is about 2 inches.

18. The reinforcement system of claim 13, wherein the length is greater than 2 inches.

19. The reinforcement system of claim 7, wherein each of the first planar sheet and the second planar sheet is manufactured from a polymer material.

20. The reinforcement system of claim 7, further comprising:

a third reinforcement device coupled to the second panel of the folder, the third reinforcement device comprising:

a third planar sheet including:

a first side and an opposing second side;

one pre-formed hole defined by the third planar sheet; and a glue or other sticky substance on one of the first side and the opposing second side of the third planar sheet to facilitate affixing the third reinforcement device to the second panel of the folder such that a second hole of the three holes of the second panel of folder and the one pre-formed hole of the third reinforcement device sufficiently align to allow a second ring of the three rings from the ringed binder to pass through the second hole of the three holes of the second panel of the folder and the one pre-formed hole of the third reinforcement device, wherein the third reinforcement device is made of one or more of paper, cardstock paper, a plastic, or a polymer, and wherein the one pre-formed hole of the third reinforcement device is laterally offset from a centerline of the third planar sheet such that the one pre-formed hole of the second reinforcement device is positioned closer towards an inner edge than an outer edge of the third planar sheet; and a third coating layer comprising a friction material and a textured surface, the friction material and the textured surface of the third coating layer configured to limit movement of the object residing within the folder when the object contacts the third coating layer, the third coating layer being positioned on the inside of the second panel of the folder and around the one pre-formed hole of the third reinforcement device, thereby increasing the thickness of the third planar sheet around only the one pre-formed hole of the third reinforcement device and reducing the likelihood that the folder will tear.

* * * * *